US009702163B2

(12) United States Patent
Pondorfer

(10) Patent No.: US 9,702,163 B2
(45) Date of Patent: Jul. 11, 2017

(54) TOWER CONSTRUCTION

(71) Applicant: Walter Pondorfer, Tirol (AT)

(72) Inventor: Walter Pondorfer, Tirol (AT)

( * ) Notice: Subject to any disclaimer, the term of this patent is extended or adjusted under 35 U.S.C. 154(b) by 0 days.

(21) Appl. No.: 14/916,454

(22) PCT Filed: Nov. 14, 2013

(86) PCT No.: PCT/EP2013/073891
§ 371 (c)(1),
(2) Date: Mar. 3, 2016

(87) PCT Pub. No.: WO2015/032456
PCT Pub. Date: Mar. 12, 2015

(65) Prior Publication Data

US 2016/0194896 A1 Jul. 7, 2016

(30) Foreign Application Priority Data

Sep. 6, 2013 (GB) ..... 1315920.7

(51) Int. Cl.
*E04B 1/00* (2006.01)
*E04H 12/34* (2006.01)
(Continued)

(52) U.S. Cl.
CPC ..... *E04H 12/344* (2013.01); *E04B 1/19* (2013.01); *E04B 1/34315* (2013.01);
(Continued)

(58) Field of Classification Search
CPC ..... E04H 12/344; E04H 12/18; E04H 12/348; E04H 12/345; E04H 12/10; E04B 1/34357; E04B 1/34315; E04B 1/19
(Continued)

(56) References Cited

U.S. PATENT DOCUMENTS 2,993,570 A 7/1961 Bender
3,715,852 A * 2/1973 Koga ..... E04H 12/345 29/469
(Continued)

FOREIGN PATENT DOCUMENTS

DE 1406317 B2 10/1971
DE 2035588 B2 12/1976
(Continued)

OTHER PUBLICATIONS

International Search Report of PCT/EP2013/073891.
Search Report of GB1315920.7.

*Primary Examiner* — Basil Katcheves
*Assistant Examiner* — Joshua Ihezie
(74) *Attorney, Agent, or Firm* — Christopher M. Ramsey; GrayRobinson, P.A.

(57) ABSTRACT

A tower is constructed by erecting an upright former 6; assembling a first section 31 of the tower around the former 6; raising the first tower section 31; assembling a second tower section 32 around the former 6; connecting the first and second tower sections 31, 32, and repeating the steps to add further tower sections. Disassembly is the reverse process. The method of assembly is particularly suitable to mobile towers that are transported on road trailers and may be used with advantage with amusement rides.

25 Claims, 8 Drawing Sheets

(51) Int. Cl.

| | |
|---|---|
| ***E04H 12/10*** | (2006.01) |
| ***E04B 1/19*** | (2006.01) |
| ***E04B 1/343*** | (2006.01) |
| ***E04H 12/18*** | (2006.01) |

(52) U.S. Cl.
CPC ..... *E04B 1/34357* (2013.01); *E04H 12/10* (2013.01); *E04H 12/18* (2013.01); *E04H 12/345* (2013.01); *E04H 12/348* (2013.01)

(58) Field of Classification Search
USPC ..... 52/745.17, 745.18
See application file for complete search history.

(56) References Cited

U.S. PATENT DOCUMENTS

| | | | | |
|---|---|---|---|---|
| 3,945,106 | A * | 3/1976 | Mayr | E04H 5/12 135/90 |
| 4,932,175 | A * | 6/1990 | Donnally | E21B 15/00 52/118 |
| 5,957,779 | A * | 9/1999 | Larson | A63G 1/44 472/131 |
| 6,755,749 | B2 * | 6/2004 | Stengel | A63G 7/00 472/131 |
| 7,666,103 | B2 * | 2/2010 | Pondorfer | A63G 1/28 472/33 |
| 8,491,403 | B2 * | 7/2013 | Schreibfeder | A63G 31/00 472/130 |
| 8,690,694 | B2 * | 4/2014 | Barber | A63G 31/00 472/2 |
| 2002/0103033 | A1 * | 8/2002 | Stengel | A63G 7/00 472/131 |
| 2005/0239563 | A1 | 10/2005 | Pondorfer et al. | |
| 2007/0090653 | A1 * | 4/2007 | Martelon | F03D 9/007 290/55 |
| 2007/0240622 | A1 | 10/2007 | Hu | |
| 2009/0031639 | A1 * | 2/2009 | Cortina/Cordero | E04H 12/12 52/40 |
| 2010/0031589 | A1 | 2/2010 | Fernald et al. | |
| 2010/0281818 | A1 * | 11/2010 | Southworth | E02D 27/42 52/745.17 |
| 2012/0051939 | A1 * | 3/2012 | Marvin et al. | F03D 1/04 416/244 R |

FOREIGN PATENT DOCUMENTS

| | | | |
|---|---|---|---|
| DE | 3024286 | A1 | 1/1982 |
| DE | 19803954 | | 2/2008 |
| EP | 0942119 | B1 | 3/2004 |
| JP | 6088768 | | 5/1985 |
| WO | 9415041 | A | 7/1994 |
| WO | 2004067126 | A1 | 8/2004 |
| WO | 2013074996 | A1 | 5/2013 |

* cited by examiner

TOWER CONSTRUCTION

CROSS-REFERENCE TO RELATED APPLICATIONS

This is the U.S. National Stage entry of PCT Application No. PCT/EP2013/073891, filed Nov. 14, 2013, which claims priority from GB Application No. 1315920.7, filed Sep. 6, 2013. The entire contents of these prior application are incorporated by reference.

FIELD

This relates to towers and to methods of constructing them. This is concerned particularly, although not exclusively, with towers for amusement rides.

BACKGROUND

Various amusement rides require the construction of a tower so that riders can enjoy the thrill of the ride at a great height. Many amusement rides are transportable, so that the owners can move them from one fairground site to another. However, where the ride involves a high tower, erection and subsequent disassembly of the tower typically requires heavy plant (usually a heavy crane) and considerable manpower.

BRIEF SUMMARY

Embodiments of the invention aim to provide methods of constructing towers that are improved in the foregoing respect.

According to one aspect of the invention, there is provided a method of constructing a tower, comprising the steps of:

a. erecting an upright former;

b. assembling a first section of the tower around the former;

c. raising said first section of tower;

d. assembling a second section of the tower around the former; and e. connecting said first and second sections of the tower.

Preferably, the method further comprises the steps of:

f. raising said first and second sections of the tower;

g. assembling a third section of the tower around the former;

h. connecting said second and third sections of the tower; and i. repeating steps f, g and h for subsequent sections of the tower that are assembled in turn around the former and connected to the preceding sections of tower.

Preferably, said former is a column of open framework construction.

Preferably, said former has a height that is greater than any two consecutive sections of the tower.

Preferably, each section of the tower is of substantially the same height.

Preferably, raising means for raising assembled sections of the tower is mounted on or adjacent said former.

Preferably, said raising means comprises a winch system mounted at least partly on said former.

Preferably, said raising means comprises at least one pneumatic or hydraulic ram.

Preferably, said tower is of open framework construction.

Said tower may be of generally rectangular cross-section.

Said tower may be of generally square cross-section.

Preferably, said tower sections are at least partly prefabricated or pre-assembled.

A method as above preferably further comprises the step of securing the tower to a support when the tower is completed.

Preferably, said former is carried on a transportable load bed.

Preferably, said load bed is a wheeled trailer for road or rail transport.

Preferably, said former is mounted on said load bed for pivoting movement between a first storage position in which the former extends generally parallel to the load bed and a second working position in which the former is upright.

Preferably, step a is carried out with the assistance of a pneumatic or hydraulic ram that places the former in an upright position.

Preferably, the sections of the tower are of substantially uniform cross-section.

Preferably, an upper section of the tower is pre-assembled around the former such that, when the former is erected, said upper section is already in place around the former.

A method as above preferably further comprises the step of mounting a carrier on the tower, such that the carrier can move up and down the tower.

Preferably, the carrier is arranged to carry riders, thereby to provide an amusement ride for the riders.

The amusement ride may comprise a drop-tower ride in which the carrier is moved towards the top of the tower and then allowed to drop in a free-fall manner.

The amusement ride may comprise a rotary swing ride in which the carrier or a part thereof rotates around the tower with riders suspended from the carrier.

A method as above preferably further comprises the step of disassembling the tower by disconnecting the lowermost section of the tower from the section above it, disassembling and removing the lowermost section, and allowing the section above it to move down the former and then become in turn the lowermost section, which in turn is disassembled and removed.

Preferably, where an upper section of the tower has been pre-assembled around the former, said upper section is retained around the former after disassembly of the tower.

Preferably, where a carrier is provided to move up and down the tower, the carrier and cables for operating the carrier are retained with said upper section after disassembly of the tower.

The invention extends to a tower or amusement ride that has been constructed by a method according to any of the preceding aspects of the invention.

BRIEF DESCRIPTION OF THE DRAWINGS

For a better understanding of the invention, and to show how embodiments of the same may be carried into effect, reference will now be made, by way of example, to the accompanying diagrammatic drawings, in which.

In the figures, like references denote like or corresponding parts.

DETAILED DESCRIPTION

Figure 1:
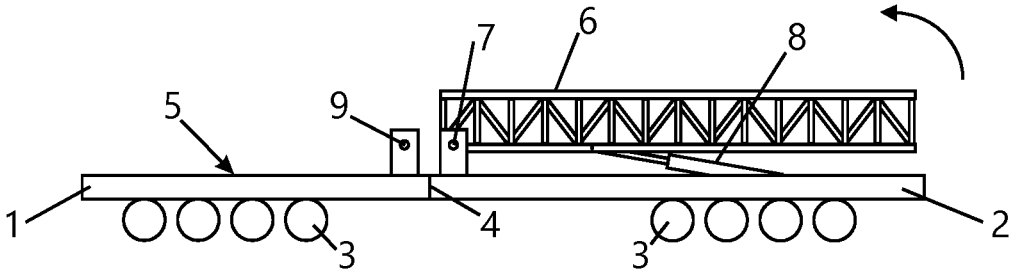
FIG. 1 is a side view of a transportable load bed that is formed from two road trailers and carries a former that extends generally parallel to the load bed.

It is to be understood that the various features that are described in the following and/or illustrated in the drawings are preferred but not essential. Combinations of features described and/or illustrated are not considered to be the only possible combinations. Unless stated to the contrary, individual features may be omitted, varied or combined in different combinations, where practical.

Figure 2:
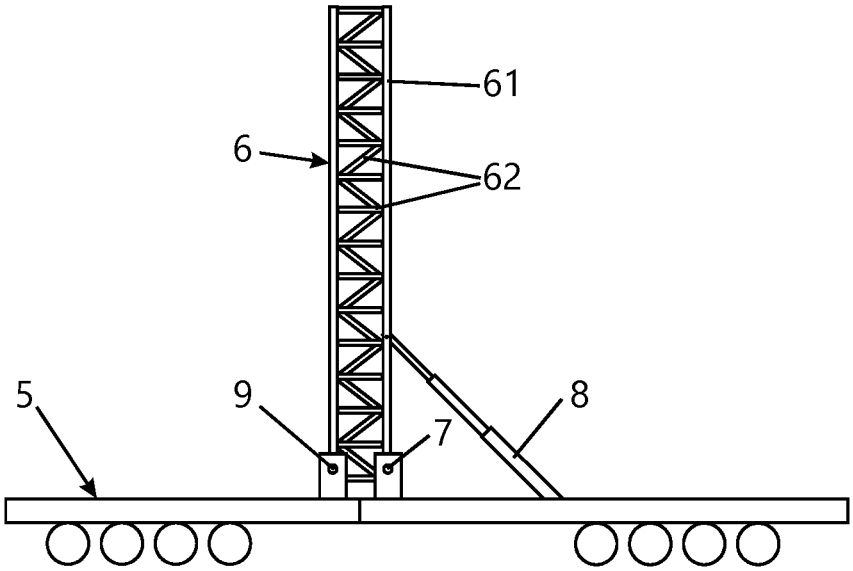
FIG. 2 is a side view similar to FIG. 1 but showing the former in an upright position.
Figure 3:
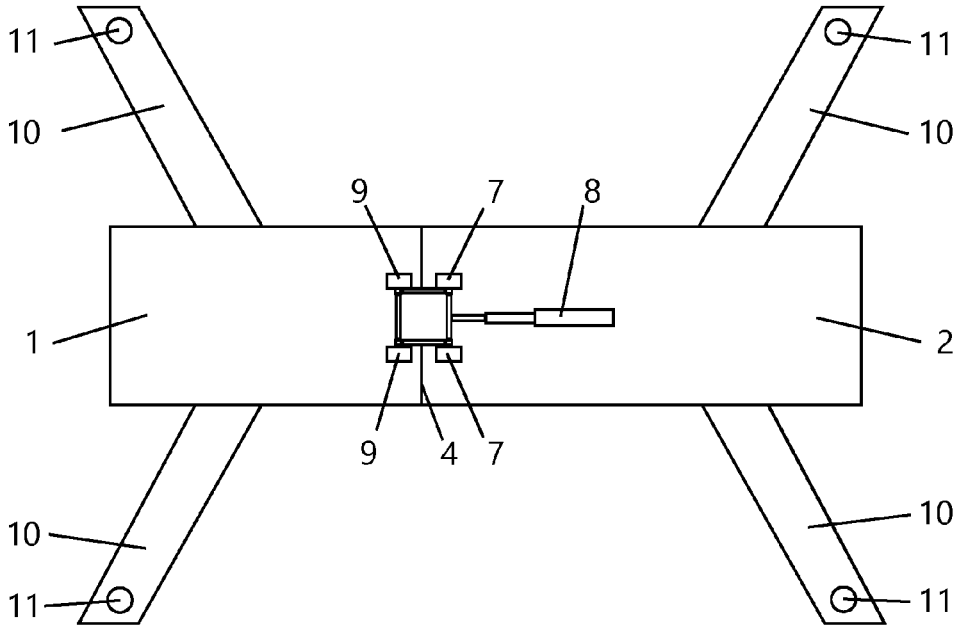
FIG. 3 is a plan view corresponding to FIG. 2.

In FIGS. 1 to 3, two road trailers 1 and 2 have road wheels 3 and are connected together at 4 to form an elongate load bed 5 on which a former 6 is carried. The former 6 is pivotally mounted on trailer 2 at pivotal mounts 7. One or more hydraulic or pneumatic ram 8 is pivotally connected to the trailer 2 and the former 6. In FIG. 1, the former 6 is shown in a stowed position for transport, such that it extends generally parallel to the load bed 5.

In FIG. 2, the former 6 has been pivoted into an upright position by the ram 8 and further secured in the upright position by further mounts 9 on the trailer 1.

As seen in FIGS. 1 and 2, the former 6 is of open framework or trussed construction. That is, it comprises elongate members 61 that are interconnected by horizontal and diagonal spars 62, to leave spaces between the parts 61, 62 and a substantially open space inside the former 6. However, the former 6 could be of an alternative construction—e.g. it may have substantially solid sides or be a substantially solid body.

The plan view of FIG. 3 shows stabilising legs 10 that extend from the trailers 1 and 2 and have adjustable feet 11 that engage the adjacent ground in order to support the trailers 1 and 2 such that the load bed 5 remains substantially horizontal and stable. Although four stabilising legs 10 are shown in FIG. 3, any number may be provided to afford sufficient stability. The adjustable feet 11 may be adjusted electrically, pneumatically or hydraulically, and/or by a screw jack arrangement. Such stabilising legs are known per se.

Figure 4:
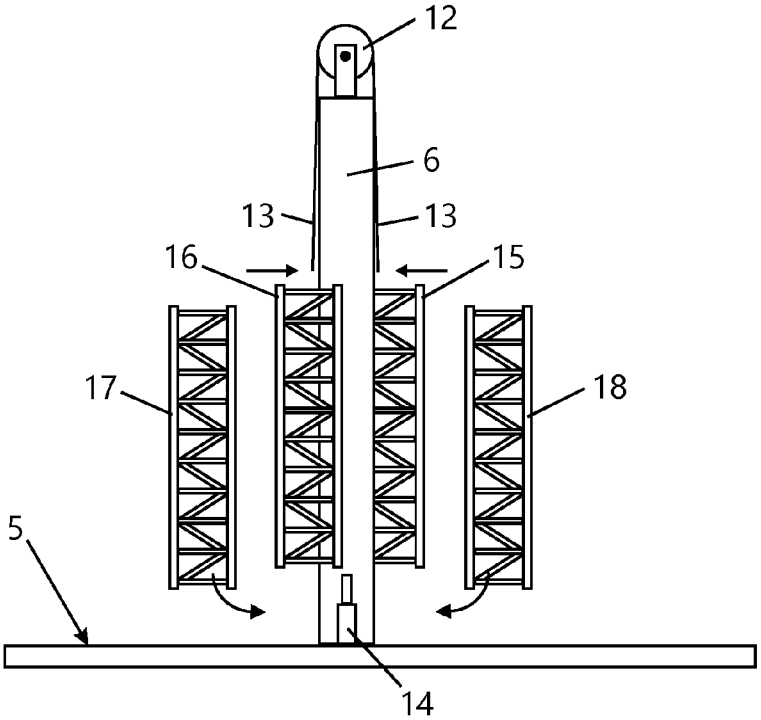
FIG. 4 is a view similar to FIG. 2, illustrating four parts of a first tower section to be assembled around the former.

The view of FIG. 4 is similar to that of FIG. 2, but is simplified in that the road wheels 3, mounting points 7, 9 and ram 8 have been omitted. Also, the former 6 has been shown as a plain rectangle. A winch pulley 12 is mounted at the top of the former 6 and two cables 13 depend from the pulley 12. One or more ram 14 is provided at the base of the former 6.

Four parts 15 to 18 of a first tower section to be assembled are shown around the former 6. As illustrated diagrammatically in FIG. 4, a first part 15 is placed into position behind the former 6 and a second part 16 in front of the former 6. A third part 17 is brought into position to the left of the former 6 and a fourth part 18 is brought into position to the right.

Figure 5:
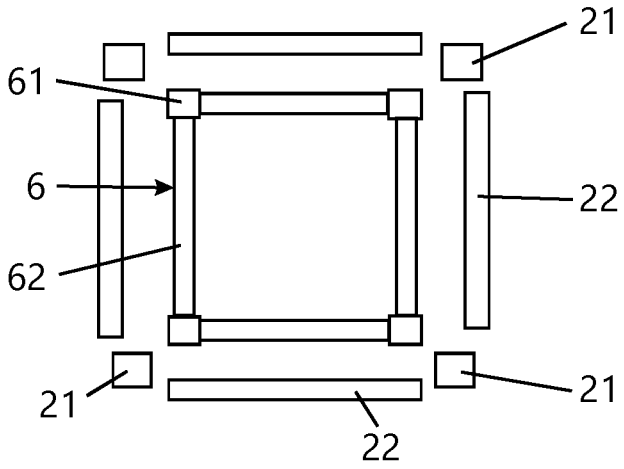
FIG. 5 is a simplified plan view of the former, with parts of a first tower section to be assembled around the former.

The plan view of FIG. 5 shows various components 21, 22 of the parts 15 to 18, around the former 6. Similar to the construction of the former 6 as shown in FIGS. 1 and 2, the parts 15 to 18 are of open framework or trussed construction, comprising elongate members 21 that are interconnected by horizontal and diagonal spars 22, to leave spaces between the components 21, 22. The components 21, 22 are shown partly assembled in FIG. 4 to make up the four parts 15 to 18 and are shown in exploded fashion in FIG. 5, to illustrate their relationship with the former 6, as they are assembled around it. The parts 15 to 18 may be individually pre-assembled from the components 21, 22 in any desired manner, prior to the parts 15 to 18 being assembled together around the former 6. Examples of this are given in FIGS. 12 to 21 and described further below.

Figure 6:
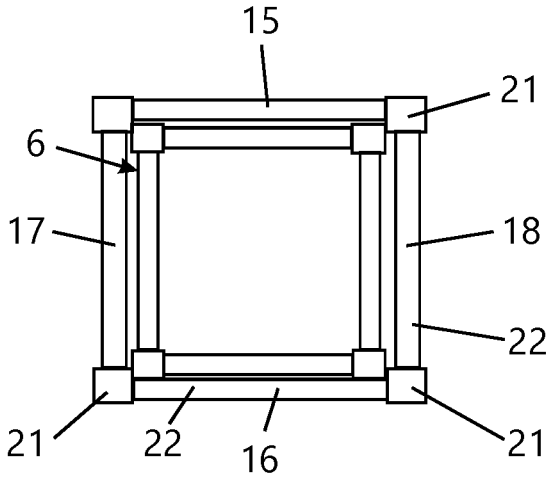
FIG. 6 is a view similar to FIG. 5, showing the first tower section assembled around the former.

FIG. 6 shows the parts 15 to 18 assembled around the former 6, to make a first tower section 31. The former 6 serves as a core around which the first tower section 31 is assembled or formed.

Figure 7:
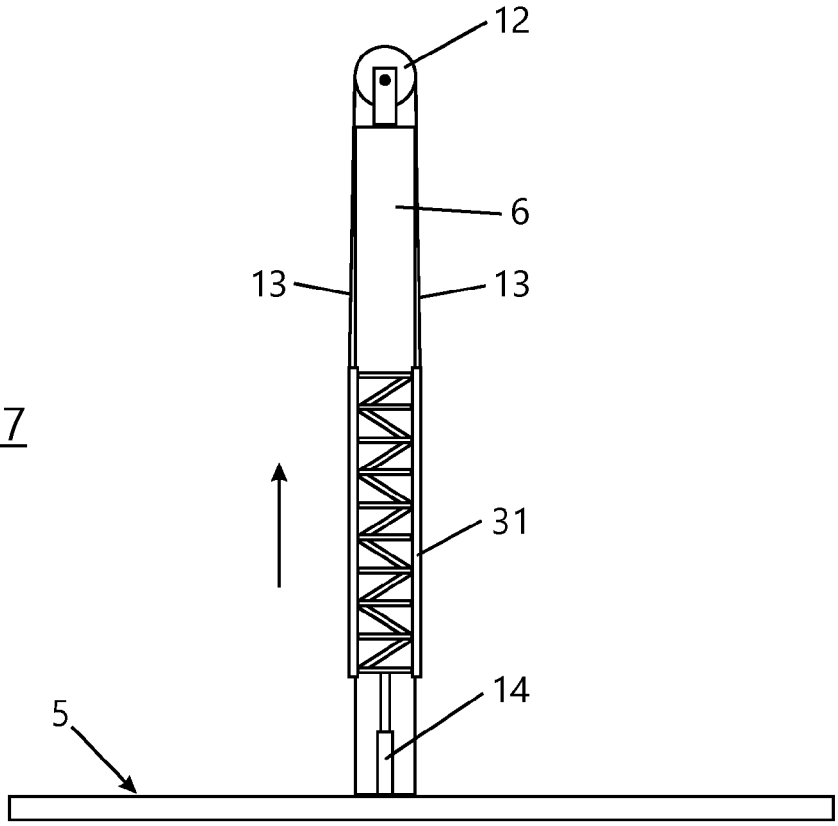
FIG. 7 is a view similar to FIG. 4, showing the assembled first tower section being raised up the former.

In FIG. 7, the winch cables 13 have been attached to the first tower section 31 and the ram 14 engages the lower part of the tower section 31. The winch and ram 14 are actuated to lift the first tower section 31 up the former 6, until there is sufficient space below it to assemble a further tower section around the former 6. As an alternative, only one or the other of the winch cables 13 and ram 14 may be utilised.

Figure 8:
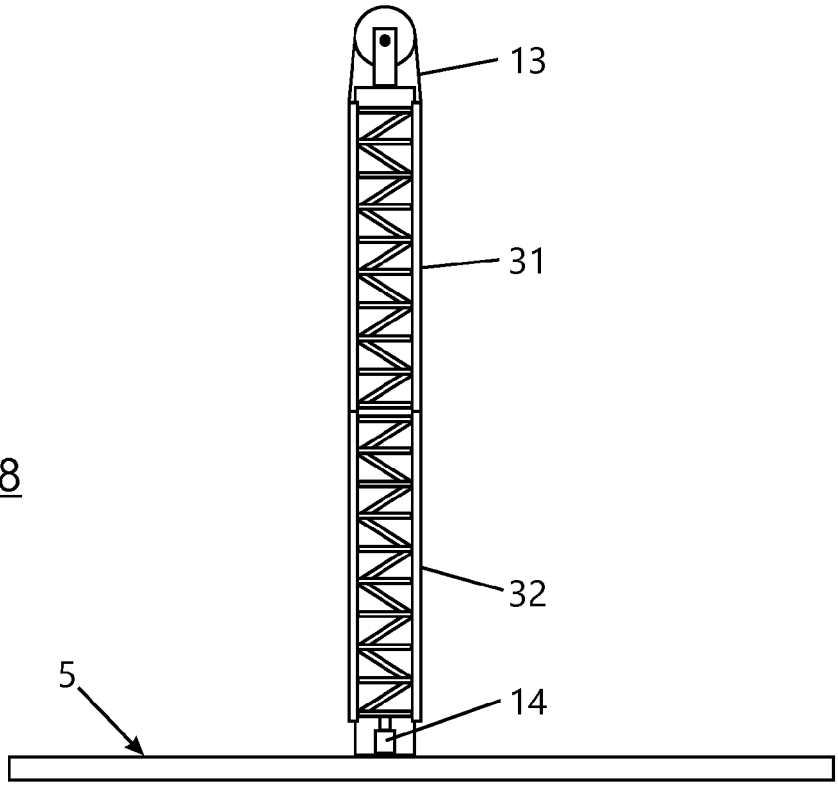
FIG. 8 is a view similar to FIG. 7, showing the assembled first tower section raised up the former and a second tower section assembled below it, around the former.

In FIG. 8, a second tower section 32 has been assembled around the former 6, in a similar manner to the first section 31. The first and second sections 31, 32 are connected together by a suitable connector and the cables 13 and/or ram 14 engaged with the second tower section 32. The cables 13 and/or ram 14 are then actuated to pull the second section 32 up the former 6, until there is sufficient space below it to assemble a third tower section around the former 6.

Further tower sections are then assembled around the former 6 in a similar manner, connected to the preceding sections and raised up the former 6, until the desired height of tower has been attained.

Two or more rams 14 may be used, either around the former 6 or conveniently placed inside it. Each ram 14 may incorporate a retractable hook that can be extended to engage a part of tower section to facilitate lifting of the tower section, and then retracted to disengage from the tower section, once the tower section is in place. Rams 14 may be operated in sequence such that a first ram (or set of rams) supports the tower as it is formed, whilst a second ram (or set of rams) engages the next tower section to be assembled, in order to lift the enlarged tower whilst the first ram (or set) is disengaged, ready to engage the next tower section to be assembled.

Figure 9:
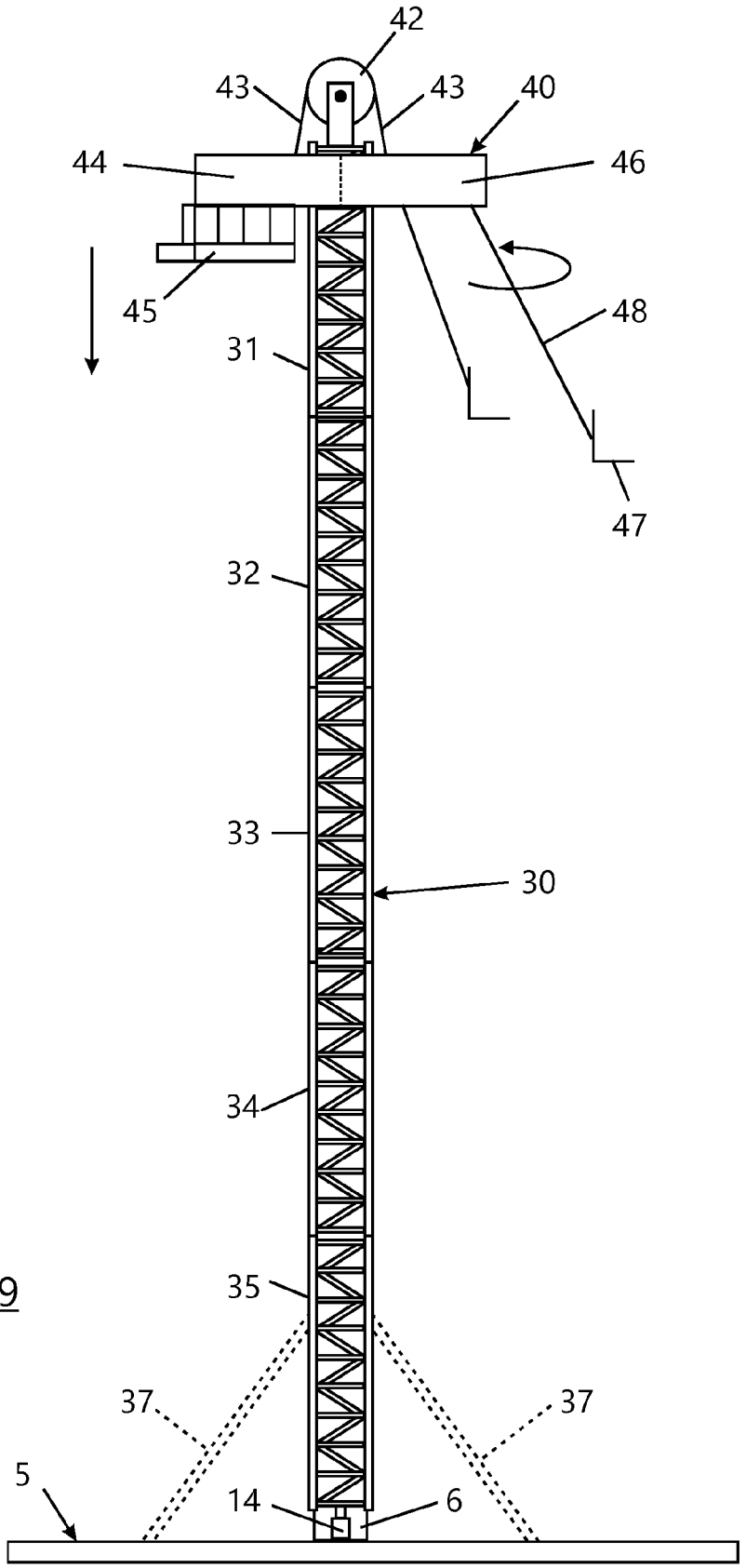
FIG. 9 is a view similar to FIG. 8, showing an amusement ride tower constructed from five tower sections that have been assembled around the former and connected to one another; with two examples of a rider carrier at the top of the tower.

In FIG. 9, five tower sections 31 to 35 have been assembled around the former 6 and interconnected to form a tower 30 that is supported on the load bed 5. Once the tower 30 has been completed, it may be supported by struts 37 or other means. The (or each) ram 14 may remain engaged with the lower end of the fifth tower section 35 or disengaged.

Instead of being of open framework or trussed construction, some or all of the tower sections 31 to 35 may be of different construction—for example, they may have solid sides, wholly or partly.

The tower 30 of FIG. 9 forms part of an amusement ride, which includes a ride carrier 40. A winch pulley 42 with cables 43 is mounted at the top of the first tower section 31, such that the cables 43 engage the ride carrier 40. By means of the winch pulley 42 and cables 43, the ride carrier 40 is caused to travel up and down the tower 30, with which the ride carrier 40 engages. Various different types of ride may be provided. FIG. 9 affords a split illustration of the ride carrier 40, in which the left side 44 (as seen) carries seating for riders to travel up and down the column as a "drop tower" ride, and the right side 46 suspends seats or harnesses 47 on links 48, such that riders may travel around the tower in the manner of a rotary "chair swing".

Typically, in a drop tower ride, riders are slowly raised up a tower until they attain a significant height, at which point they are suddenly dropped in a free-fall manner and then braked as they approach the ground. Typically, in a high chair swing ride, riders are raised up a tower until they attain a significant height, whilst being rotated around it. The riders may be moved up and down the tower as they are rotated around it.

It may be appreciated from the foregoing that the illustrated embodiment of the invention provides a very convenient method of constructing a tower for an amusement ride, without the need for heavy plant and, in particular, heavy cranes. It may be completely self-contained insofar as its assembly is concerned and save considerable amounts of time for both erection and subsequent disassembly.

It may readily be appreciated that disassembly is effectively the reverse of the assembly process as above described. Thus, winch cables 13 and/or ram(s) 14 engage the fourth tower section 34 to support the tower 30 whilst the lowermost section 35 is disconnected from the fourth tower section 34, disassembled and removed. The tower 30 is then lowered down the former 6 until supported on the load bed 5 or ram(s) 14. The next higher section 33 is then supported by the winch cables 13 and/or ram(s) 14 whilst the lower section 34 is disconnected, disassembled and removed—and so on.

Apart from the convenience afforded to the ride operator for initial erection of the tower and final disassembly, the relative ease of construction enables the tower to be taken down or at least reduced in height temporarily, in the event of severe weather conditions arising, thereby enhancing safety and reducing the chances of damage to the ride.

During construction, the ride carrier 40 may be assembled around the first tower section 31 whilst it is near ground level. Alternatively, it may be assembled around the tower 30 once the tower is completed—or at any convenient stage of construction.

Figure 10:
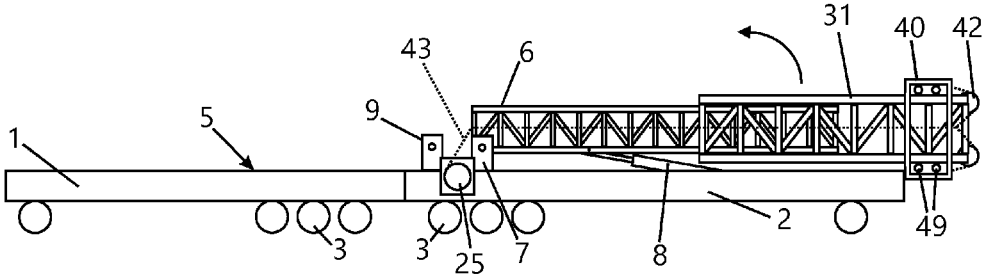
FIG. 10 is a view similar to FIG. 1, but showing an upper tower section stowed with a former.
Figure 11:
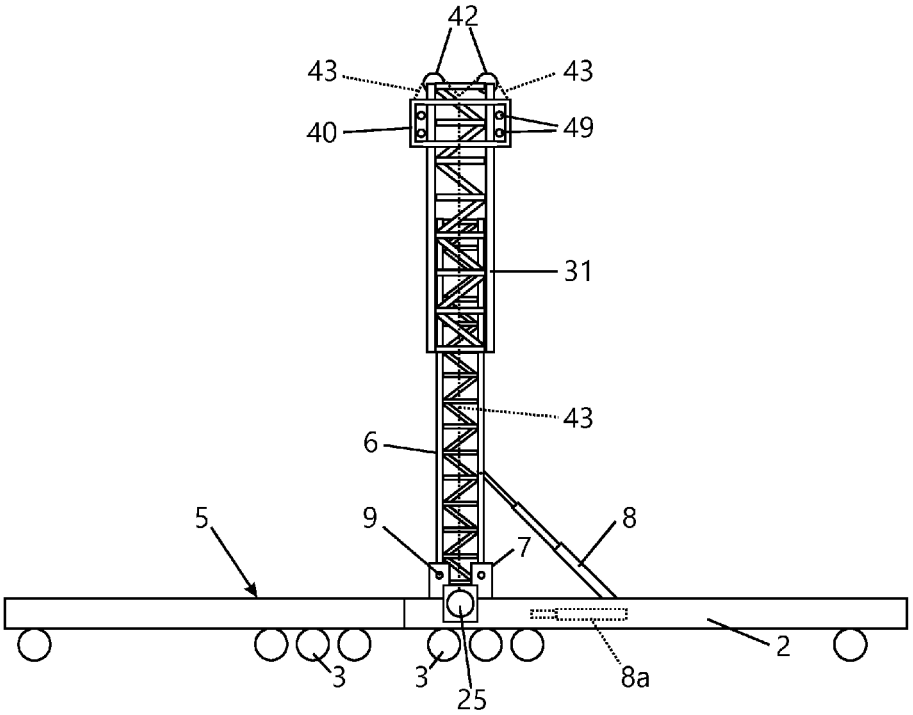
FIG. 11 is a view similar to FIG. 10 but showing the former and upper tower section in an upright position.

In the arrangement of FIGS. 10 and 11, the uppermost tower section 31 remains assembled around the former 6, both during transport (FIG. 10) and during assembly and disassembly of the tower (FIG. 11). Likewise, the ride carrier 40, or at least a frame of it, remains assembled around the uppermost tower section, together with cables 43 that pass over pulleys 42 to be connected to the ride carrier 40 at one end and, at the other end, to a winch 25 that is mounted on the trailer 2. This arrangement can save valuable extra time during assembly and disassembly of the tower.

FIGS. 10 and 11 illustrate wheels, rollers or slider blocks 49 to facilitate movement of the rider carrier 40 along the tower 30. The wheels, rollers or slider blocks 49 may be carried on the ride carrier 40 and/or the tower 30.

In FIGS. 10 and 11, both pivotal mounts 7 and securing mounts 9 are mounted on trailer 2. The ram 8 is pivotally mounted in the trailer 2 such that it may be retracted within the trailer 2 after use to raise or lower the former 6, as shown by dotted lines and reference 8*a* in FIG. 11.

During construction, each of the tower sections 32 to 35 may be connected to the preceding tower section once assembly of the current tower section 32 to 35 is being completed. Alternatively, connection between successive tower sections may be affected whilst the lowermost tower section is being assembled.

Successive tower sections 31 to 35 may engage with one another by means of spigots and sockets that may be conically shaped to facilitate accurate inter-engagement of the sections. Pins, bolts or other connectors may be used to lock successive tower sections 31 to 35 together, once they have been successfully inter-engaged. Similar spigots and sockets may be used for engagement between the lowermost tower section 35 and the load bed 5.

Conveniently, the former 6 may have a height that is greater than any two consecutive sections of the tower 30. Alternatively, it may have a lower height.

The tower sections 31 to 35 may all be of substantially the same height or they may be of differing heights.

By way of example, each tower section 31 to 35 may have a height in the range 5 to 10 meters, and the overall height of the tower 30 may be of the order of 50 to 100 meters or more.

In the illustrated embodiment, the former 6 and the tower 30 are of substantially square cross-section. However, they may be of any cross-sectional geometrical shape, including polygonal, rectangular, hexagonal, octagonal, elliptical and circular. Examples of this are illustrated in FIGS. 12 to 21.

Figure 12:
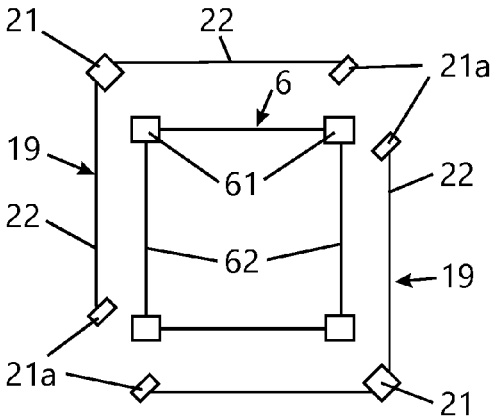
FIGS. 12 to 21 are further simplified plan views similar to FIGS. 5 and 6, illustrating various shapes of formers and tower sections.
Figure 13:
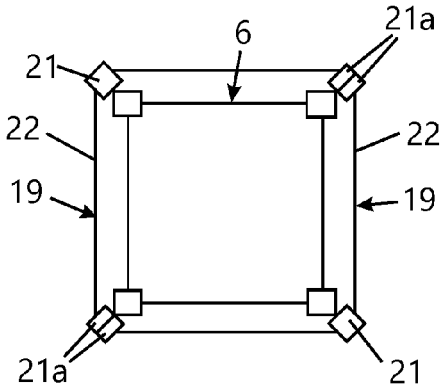

In FIG. 12, uprights 21 and spars 22 are pre-assembled to form two tower section sub-assemblies 19, each of right-angle configuration with a full-width upright 21 at its apex and a reduced-width upright 21*a* at each end. The two sub-assemblies are then brought together such that opposing reduced-width uprights 21*a* are connected together by nuts and bolts or locking pins, to form a tower section around the former 6, as shown in FIG. 13. It will be appreciated that this affords a rapid and convenient way to assemble and disassemble the tower sections. Once disassembled, the sub-assemblies 19 may be nested one with another for ready transport on a trailer or other transport device.

The reduced-width uprights 21*a* may have a width of about half that of a full-width upright 21 so that, when two are connected together, their combined width is substantially the same as that of a full-width upright 21.

Figure 14:
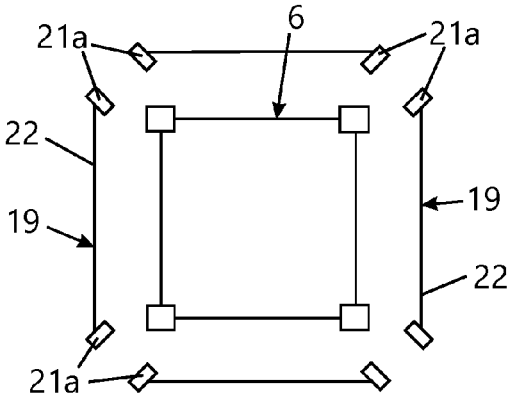
Figure 15:
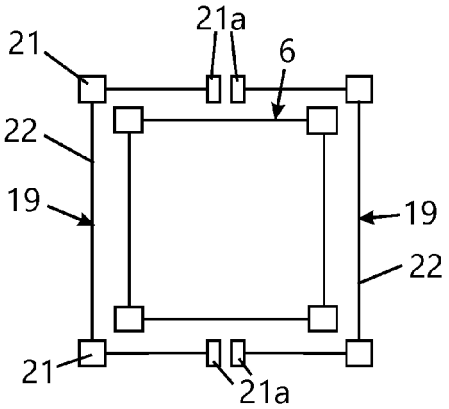
Figure 16:
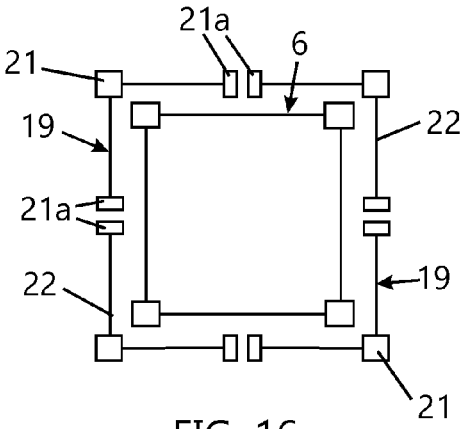

FIGS. 14, 15 and 16 show a square (or more generally, rectangular) former 6 around which various sub-assemblies 19 of differing configurations are assembled, like reference numerals denoting like or corresponding parts in all of FIGS. 12 to 21.

Figure 17:
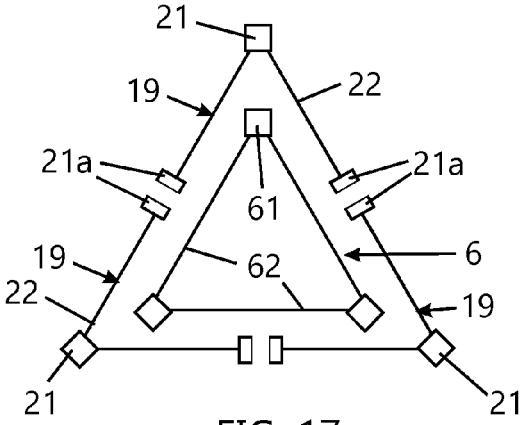
Figure 18:
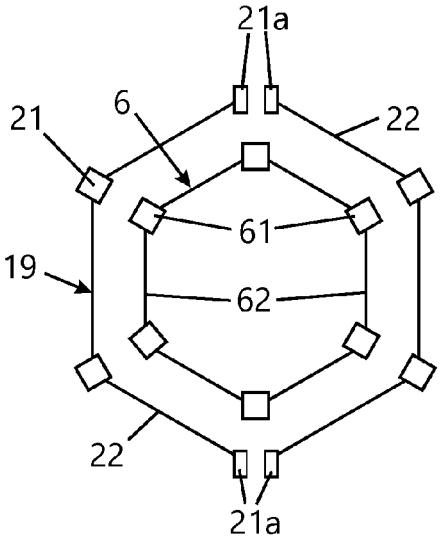
Figure 19:
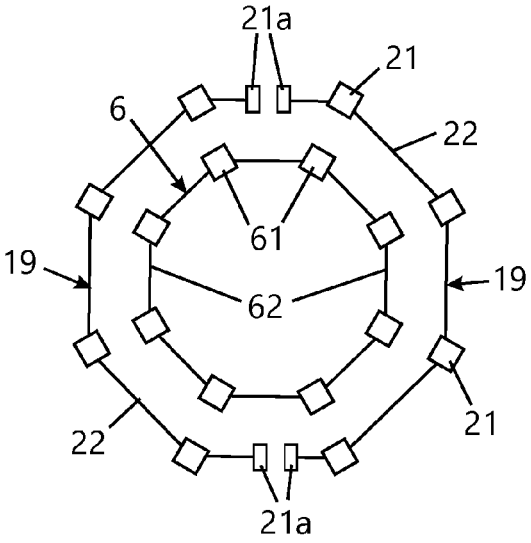
Figure 20:
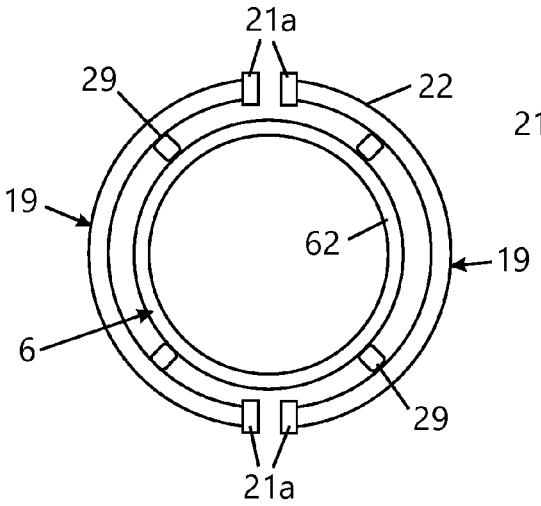
Figure 21:
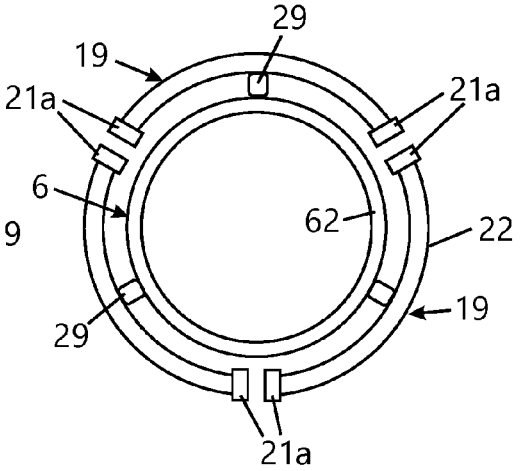

FIG. 17 shows a former 6 of triangular cross-section and sub-assemblies 19 to make up a tower section also of triangular cross-section around the former 6. In FIGS. 18 and 19, the former 6 and corresponding tower sections are hexagonal and octagonal respectively. FIGS. 20 and 21 show formers 6 and tower sections of circular cross-section.

Conveniently, all of the tower sections 31 to 35 are of substantially uniform cross-section. This is useful where a device such as (for example) a ride carrier 40 is to run up and down the tower 30. However, the tower sections 31 to 35 may be of non-uniform cross-section. For example, they may be of reducing width from the bottom to the top of the tower.

The former 6 may engage the tower sections 31 to 35 by means of wheels carried on the former 6 and/or the tower sections 31 to 35, to facilitate movement of the tower sections 31 to 35 with respect to the former 6. FIGS. 20 and 21 illustrate such wheels, rollers or slider blocks 29.

The road trailers 1 and 2 may be of the same or different lengths. Whilst the trailer 2 carries the former 6 for transport, the trailer 1 may carry parts for the tower 30. Rail trailers are also possible.

Although it is advantageous for the illustrated embodiment to be self-contained insofar as its assembly is concerned, it is possible also to utilise external equipment. For example, in many fairgrounds, small cranes are readily available and these may be used to raise completed tower sections 31 to 34 up the former 6, since they need to engage only a completed tower section towards the bottom of the tower, to lift the tower upwards.

Equipment for raising tower sections 31 to 34 may be mounted on the trailer 1 and/or 2, but not directly on the former 6.

Although the illustrated embodiments of the invention are particularly advantageous for mobile amusement rides, the invention may also be adapted for use with permanent installations. For example, the load bed 5 may alternatively be afforded by a permanent concrete base.

The invention may also be adapted for use in the construction of towers for uses other than amusement rides. For example, the invention may be used for the construction of tower cranes.

In this specification, the verb "comprise" has its normal dictionary meaning, to denote non-exclusive inclusion. That is, use of the word "comprise" (or any of its derivatives) to include one feature or more, does not exclude the possibility of also including further features. The word "preferable" (or any of its derivates) indicates one feature or more that is preferred but not essential.

All or any of the features disclosed in this specification (including any accompanying claims, abstract and drawings), and/or all or any of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A method comprising, assembling and disassembling a mobile amusement ride having a tower on which a carrier is mounted such that the carrier can move up and down the tower, the carrier being arranged to carry riders;

the method further comprising the assembly steps of:

a. erecting an upright former;

b. assembling a first section of the tower around the former;

c. raising said first section of the tower;

d. assembling a second section of the tower around the former;

e. connecting said first and second sections of the tower;

f. raising said first and second sections of the tower;

g. assembling a third section of the tower around the former; and h. connecting said second and third sections of the tower;

the method further comprising the subsequent disassembly steps of:

i. disconnecting a lowermost section of the tower from the section above it;

j. disassembling and removing the lowermost section, and allowing the section above it to move down the former and then become in turn the lowermost section, which in turn is disassembled and removed; and k. repeating steps i and j for subsequent sections of the tower that are disassembled and removed in turn.

2. A method according to claim 1, further comprising the assembly step of:

repeating steps f, g and h for subsequent sections of the tower that are assembled in turn around the former and connected to the preceding sections of tower.

3. A method according to claim 1, wherein said former is a column of open framework construction.

4. A method according to claim 1, wherein said former has a height that is greater than any two consecutive sections of the tower.

5. A method according to claim 1, wherein each section of the tower is of substantially the same height.

6. A method according to claim 1, wherein raising means for raising assembled sections of the tower is mounted on or adjacent said former.

7. A method according to claim 6, wherein said raising means comprises a winch system mounted at least partly on said former.

8. A method according to claim 6, wherein said raising means comprises at least one pneumatic or hydraulic ram.

9. A method according to claim 1, wherein said tower is of open framework construction.

10. A method according to claim 1, wherein said tower is of generally rectangular cross-section.

11. A method according to claim 10, wherein said tower is of generally square cross-section.

12. A method according to claim 1, wherein said tower sections are at least partly prefabricated or pre-assembled.

13. A method according to claim 12, wherein the prefabricated or pre-assembled tower sections form sub-assemblies that are nested one with another for transport when the tower is disassembled.

14. A method according to claim 1, further comprising the step of securing the tower to a support when the tower is completed.

15. A method according to claim 1, wherein said former is carried on a transportable load bed.

16. A method according to claim 15, wherein said load bed is a wheeled trailer for road or rail transport.

17. A method according to claim 15, wherein said former is mounted on said load bed for pivoting movement between a first storage position in which the former extends generally parallel to the load bed and a second working position in which the former is upright.

18. A method according to claim 1, wherein step a is carried out with the assistance of a pneumatic or hydraulic ram that places the former in an upright position.

19. A method according to claim 1, wherein the sections of the tower are of substantially uniform cross-section.

20. A method according to claim 1, wherein an upper section of the tower is pre-assembled around the former such that, when the former is erected, said upper section is already in place around the former.

21. A method according to claim 1, wherein the amusement ride comprises a drop-tower ride in which the carrier is moved towards the top of the tower and then allowed to drop in a free-fall manner.

22. A method according to claim 1, wherein the amusement ride comprises a rotary swing ride in which the carrier or a part thereof rotates around the tower with riders suspended from the carrier.

23. A method according to claim 1, wherein an upper section of the tower is pre-assembled around the former such that, when the former is erected, said upper section is already in place around the former and said upper section is retained around the former after disassembly of the tower.

24. A method according to claim 23, further comprising the step of mounting a carrier on the tower, such that the carrier can move up and down the tower, wherein the carrier and cables for operating the carrier are retained with said upper section after disassembly of the tower.

25. A mobile amusement ride that has been assembled and disassembled by a method according to claim 1.

* * * * *